US007651373B2

(12) United States Patent
Knaub et al.

(10) Patent No.: US 7,651,373 B2
(45) Date of Patent: Jan. 26, 2010

(54) BOARD-TO-BOARD ELECTRICAL CONNECTOR

(75) Inventors: John E. Knaub, Etters, PA (US); Lynn Robert Sipe, Mifflintown, PA (US); David W. Helster, Dauphin, PA (US); Timothy R. Minnick, Enola, PA (US); Douglas W. Glover, Dauphin, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 120 days.

(21) Appl. No.: 12/055,854

(22) Filed: Mar. 26, 2008

(65) Prior Publication Data

US 2009/0246980 A1 Oct. 1, 2009

(51) Int. Cl.
*H01R 13/648* (2006.01)

(52) U.S. Cl. ..... 439/607.05; 439/607.06; 439/108

(58) Field of Classification Search . 439/607.05–607.7, 439/108

See application file for complete search history.

(56) References Cited

U.S. PATENT DOCUMENTS

| | | | | |
|---|---|---|---|---|
| 7,131,870 | B2 * | 11/2006 | Whiteman et al. | 439/607.06 |
| 7,172,461 | B2 * | 2/2007 | Davis et al. | 439/607.11 |
| 7,473,138 | B2 * | 1/2009 | Tuin et al. | 439/607.05 |
| 2006/0216969 | A1 * | 9/2006 | Bright et al. | 439/79 |
| 2008/0280492 | A1 * | 11/2008 | Rothermel et al. | 439/608 |

* cited by examiner

*Primary Examiner*—Gary F. Paumen

(57) ABSTRACT

An electrical connector includes a housing defining a connector mating interface. The housing holds a plurality of contact modules that cooperate to define a connector mounting interface. Each contact module contains signal leads and ground leads arranged in an alternating pattern of individual ground leads and pairs of signal leads positioned side-by-side with respect to a thickness of the contact module. The signal and ground leads have respective mating contacts proximate the mating interface and respective mounting contacts proximate the mounting interface. The mating and mounting contacts within each contact module are arranged in one of first and second contact patterns different from the pattern of the signal and ground leads. The mating and mounting contacts in adjacent contact modules are arranged in respective different ones of the first and second contact patterns.

20 Claims, 8 Drawing Sheets

BOARD-TO-BOARD ELECTRICAL CONNECTOR

BACKGROUND OF THE INVENTION

The invention relates generally to electrical connectors and, more particularly, to a board-to-board connector for transmitting differential signals.

With the ongoing trend toward smaller, faster, and higher performance electrical components, it has become increasingly important for the electrical interfaces along the electrical paths to also operate at higher frequencies and at higher densities with increased throughput.

In a traditional approach for interconnecting circuit boards, one circuit board serves as a backplane or main board and the other as a daughter board. Rather than directly connecting the circuit boards, the backplane typically has a connector, commonly referred to as a header, that includes a plurality of signal pins or contacts which connect to conductive traces on the backplane. The daughter board connector, commonly referred to as a receptacle, also includes a plurality of contacts or pins. When the header and receptacle are mated, signals can be routed between the two circuit boards.

The migration of electrical communications to higher data rates has resulted in more stringent requirements for density and throughput while maintaining signal integrity. At least some board-to-board connectors carry differential signals wherein each signal requires two lines that are referred to as a differential pair. For better performance, a ground may be associated with each differential pair. The ground provides shielding for the differential pair to reduce noise or crosstalk.

A need remains for a connector having higher speed capability with reduced noise.

BRIEF DESCRIPTION OF THE INVENTION

In one embodiment, an electrical connector is provided. The connector includes a housing defining a connector mating interface. The housing holds a plurality of contact modules that cooperate to define a connector mounting interface. Each contact module contains signal leads and ground leads arranged in an alternating pattern of individual ground leads and pairs of signal leads positioned side-by-side with respect to a thickness of the contact module. The signal and ground leads have respective mating contacts proximate the mating interface and respective mounting contacts proximate the mounting interface. The mating and mounting contacts within each contact module are arranged in one of first and second contact patterns different from the pattern of the signal and ground leads. The mating and mounting contacts in adjacent contact modules are arranged in respective different ones of the first and second contact patterns.

Optionally, each of said first and second contact patterns includes a column of ground contacts adjacent a column including signal contacts in alternating vertically coupled pairs and horizontally coupled pairs. The arrangement of signal contact pairs in the second contact pattern is offset from the arrangement of the signal contact pairs of the first contact pattern. The pairs of signal leads are configured to carry differential signals and are without skew. The mating and mounting interfaces are substantially perpendicular to one another. Each of the ground leads has a width sufficient to shield a pair of signal leads from other signal leads within the same contact module. Each contact module includes a housing having a centerline. The signal leads in each contact module are arranged in a first group positioned on one side of the centerline and a second group positioned on the other side of the centerline. Each pair of signal leads includes a signal lead from each of the first and second groups.

In another embodiment, an electrical connector assembly is provided. The assembly includes a header connector having a housing holding a plurality of header contacts in a noise canceling arrangement. A receptacle connector is matable with the header connector. The receptacle connector includes a receptacle housing defining a connector mating interface. The receptacle housing holds a plurality of contact modules that cooperate to define a connector mounting interface. Each contact module contains signal leads and ground leads arranged in an alternating pattern of individual ground leads and pairs of signal leads positioned side-by-side with respect to a thickness of the contact module. The signal and ground leads have respective mating contacts proximate the mating interface and respective mounting contacts proximate the mounting interface. The mating and mounting contacts within each contact module are arranged in one of first and second contact patterns different from the pattern of the signal and ground leads. The mating and mounting contacts in adjacent contact modules are arranged in respective different ones of the first and second contact patterns.

DETAILED DESCRIPTION OF THE INVENTION

Figure 1:
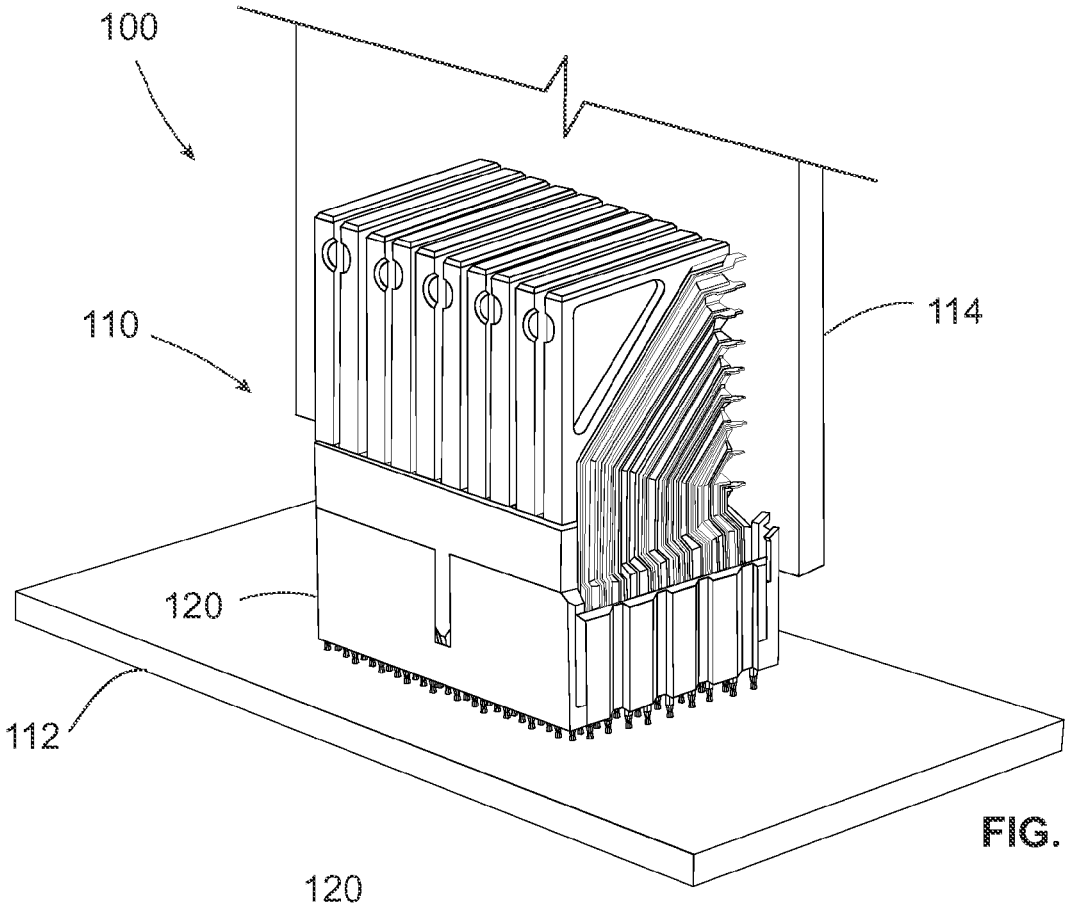
FIG. 1 is a perspective view of an electronic assembly including an electrical connector formed in accordance with an exemplary embodiment of the present invention.

FIG. 1 illustrates an electronic assembly 100 including an electrical connector assembly 110 formed in accordance with an exemplary embodiment of the present invention. The connector assembly 110 interconnects a backplane board 112 with a daughter board 114. The connector assembly 110 includes a header connector 120 that is mounted on the backplane 112 and a receptacle connector 124 that is mounted on the daughter board 114. The header connector 120 and receptacle connector 124 are mated to electrically connect the backplane 112 and the daughter board 114. While the invention is described in terms of a connector assembly 100 for interconnecting circuit boards such as the backplane 112 and daughter board 114, it is to be understood that such description is for purposes of illustration and no limitation is intended thereby. That is, the benefits of the invention may also be incorporated into connector assemblies for interconnecting two electrical components to one another or one electrical component to a circuit board.

Figure 2:
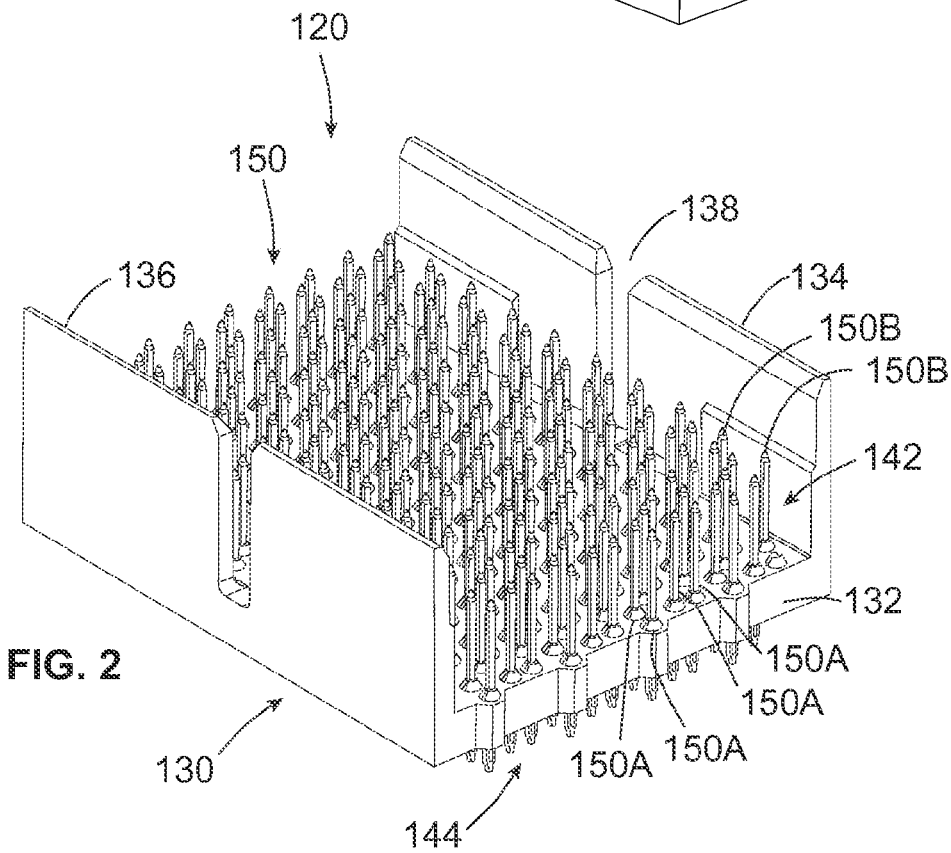
FIG. 2 is a perspective view of the header connector shown in FIG. 1.

FIG. 2 illustrates a perspective view of the header connector 120. The header connector 120 includes a dielectric housing 130 that has a base 132 and shrouds 134 and 136. The shrouds 134 and 136 extend upwardly from opposite sides of the base 132 and each includes a keying slot 138. The header connector 120 includes a mating face 142 and a mounting face 144 that interfaces the backplane board 112 (FIG. 1) when the header connector 120 is mounted on the backplane board. The header connector 120 holds a plurality of electrical contacts 150 that includes signal contacts 150A and ground contacts 150B arranged in a pattern, as will be described.

Figure 3:
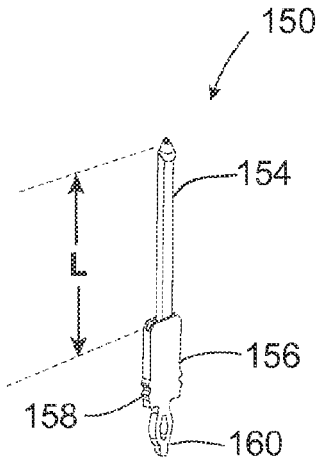
FIG. 3 is a perspective view of a contact for the header connector shown in FIG. 2.

FIG. 3 illustrates a perspective view of a contact 150 that may be used in the header connector 120 (FIG. 2). Each contact 150 includes a mating end 154 that is configured to be matable with contacts in the receptacle connector 124 (FIG. 1). The mating end 154 extends from a contact body or retention section 156 that is press fit into the base 132 of the header connector housing 130. The contact body 156 includes retention barbs 158 that retain the contact 150 in the header connector housing base 132. A contact tail 160 extends from the contact body 156 opposite the mating end 154. The contact tail 160 extends from the base 132 of the header connector 120 at the mounting face 144 to mount the header connector 120 on the backplane board 112. In one embodiment, the contact tail 160 is a compliant eye of the needle design. In an exemplary embodiment, the mating end 154 comprises a cylindrical pin design. The signal contacts 150A and ground contacts 150B are substantially identical to one another; however, in some embodiments the mating ends 154 of the ground contacts 150B have a length L that is greater than the length L of the mating ends 154 of the signal contacts 150A so that the ground contacts 150B are the first to mate and last to break when the header connector 120 is mated and separated, respectively, from the receptacle connector 124. Further, in some embodiments, the mating of the signal contacts 150A is also sequenced. That is, selected signal contacts 150A may be configured to mate before other signal contacts 150A by further varying the lengths L of the signal contacts 150A.

Figure 4:
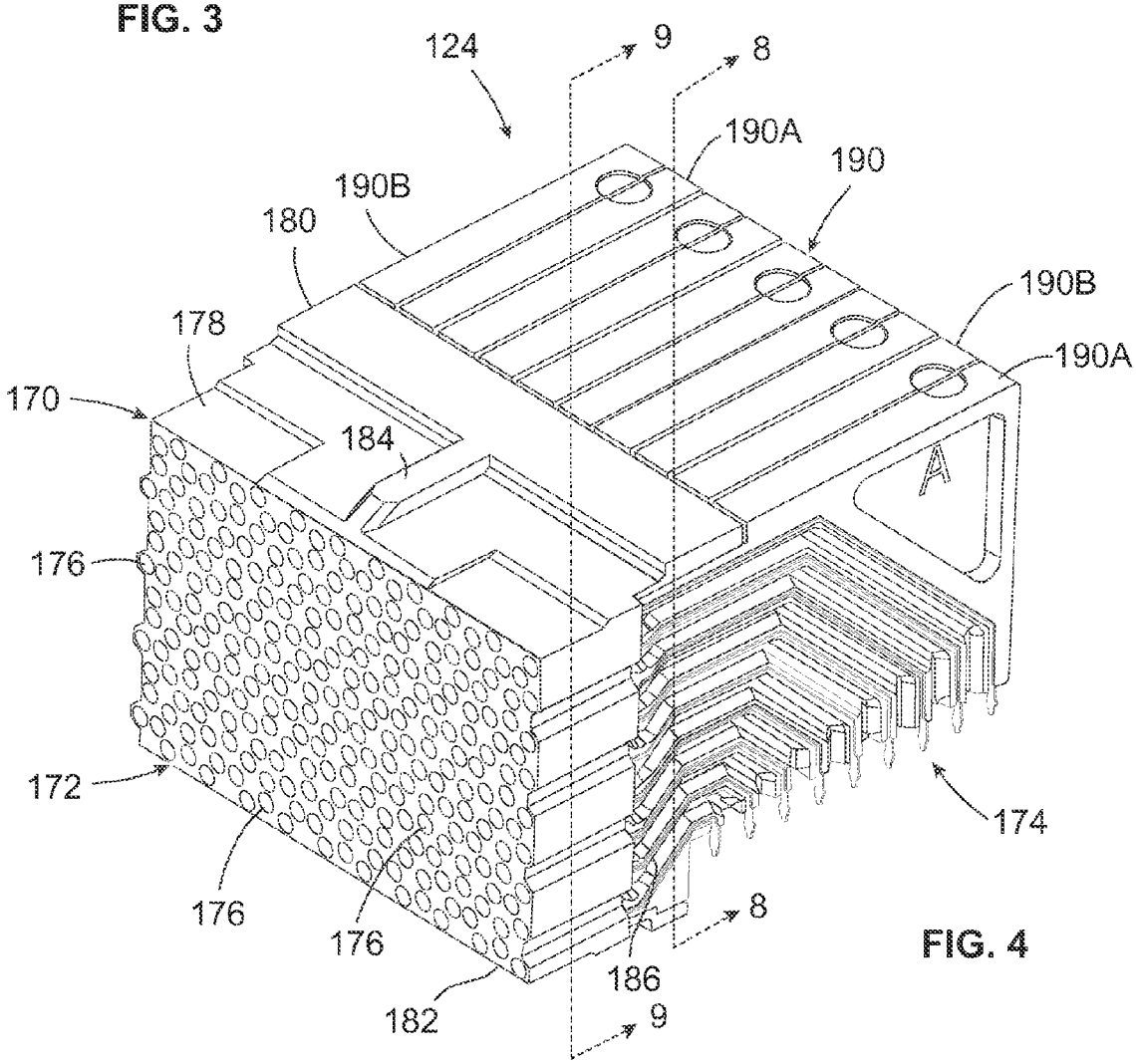
FIG. 4 is a perspective view of the receptacle connector shown in FIG. 1.

FIG. 4 illustrates a perspective view of the receptacle connector 124. The receptacle connector 124 includes a dielectric housing 170 having a mating end or mating interface 172 and a mounting end or mounting interface 174. In an exemplary embodiment, the mounting interface 174 is substantially perpendicular to the mating interface 172 such that the receptacle connector 124 interconnects electrical components or circuit boards that are substantially at a right angle to one another other. The mating interface 172 includes a plurality of contact apertures 176 that are configured to receive contacts 150 from the mating header connector 120 (FIG. 2) as will be described. The receptacle connector housing 170 includes a top wall 178, from which a shroud 180 rearwardly extends, and an opposite bottom wall 182. Alignment keys 184, only one of which is visible in FIG. 4, are formed on the top and bottom walls 178 and 182, respectively. The alignment keys 184 are received in the keying slots 138 in the header connector 120 (FIG. 2) to orient and align the receptacle connector 124 with the header connector 120. The housing 170 includes a module receiving end 186 opposite the mating interface 172 that receives a plurality of wafers or contact modules 190. The contact modules 190 collectively define the mounting interface 174. The contact modules 190 are provided in two contact module types 190A and 190B that are loaded into housing 170 in an alternating sequence.

Figure 5:
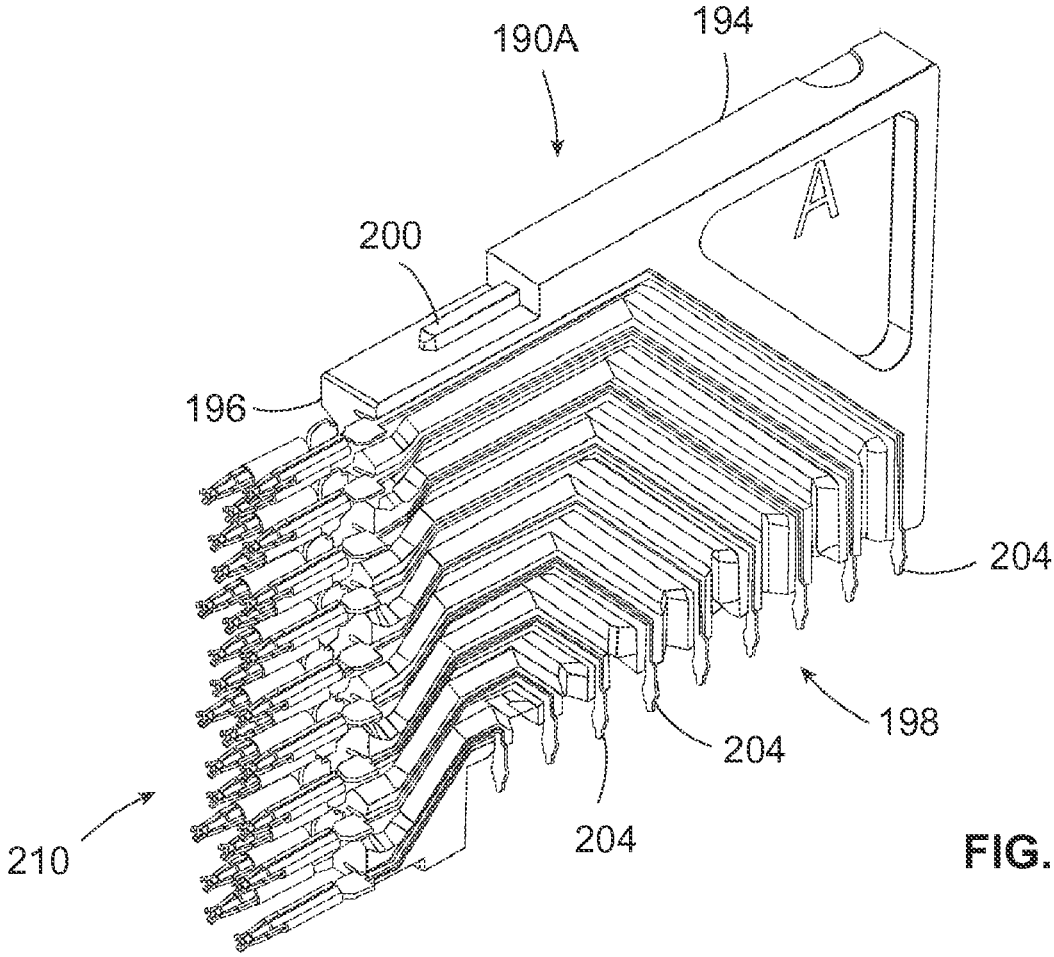
FIG. 5 is a perspective view of a contact module for the receptacle connector shown in FIG. 4.

FIG. 5 illustrates a perspective view of the contact module 190A formed in accordance with an exemplary embodiment of the present invention. The contact module 190A includes a contact module housing 194 fabricated from an insulative material. The contact module housing 194 includes a forward mating end 196 that is received in the module receiving end 186 of the receptacle housing 170 (FIG. 4) and a mounting edge 198 that is substantially perpendicular to the mating end 196. An alignment key 200 is provided proximate the mating end 196 that is received in a slot 202 in the shroud 180 (see FIG. 8) to facilitate positioning of the contact module 190A in the receptacle housing 170. Mounting contacts 204 extend from the mounting edge 198 for attachment to a circuit board or other electrical component. In one embodiment, the mounting contacts 204 may be a flexible eye of the needle design commonly used in circuit board connections. Mating contacts 210 are received in the contact apertures 176 in the receptacle housing 170 when the contact module 190A is received in the receptacle housing 170.

Figure 6:
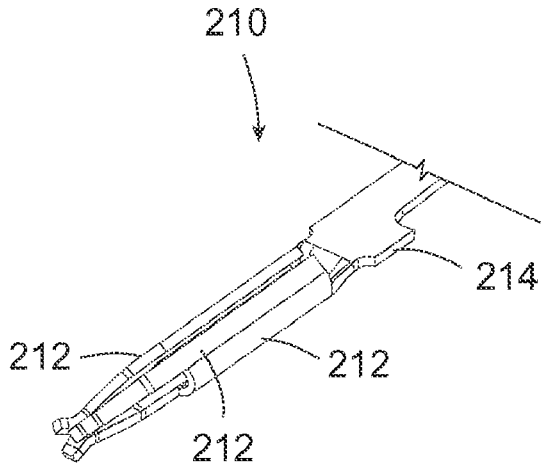
FIG. 6 is a perspective view of a mating contact in the contact module shown in FIG. 5.

FIG. 6 illustrates an enlarged perspective view of the mating contact 210. In the illustrated embodiment, the contact 210 is a tri-beam design having three contact beams 212 that extend from a contact body 214. The contact beams 212 are arranged to receive the pin contact 150 in the header connector 120 (FIG. 2).

Figure 7:
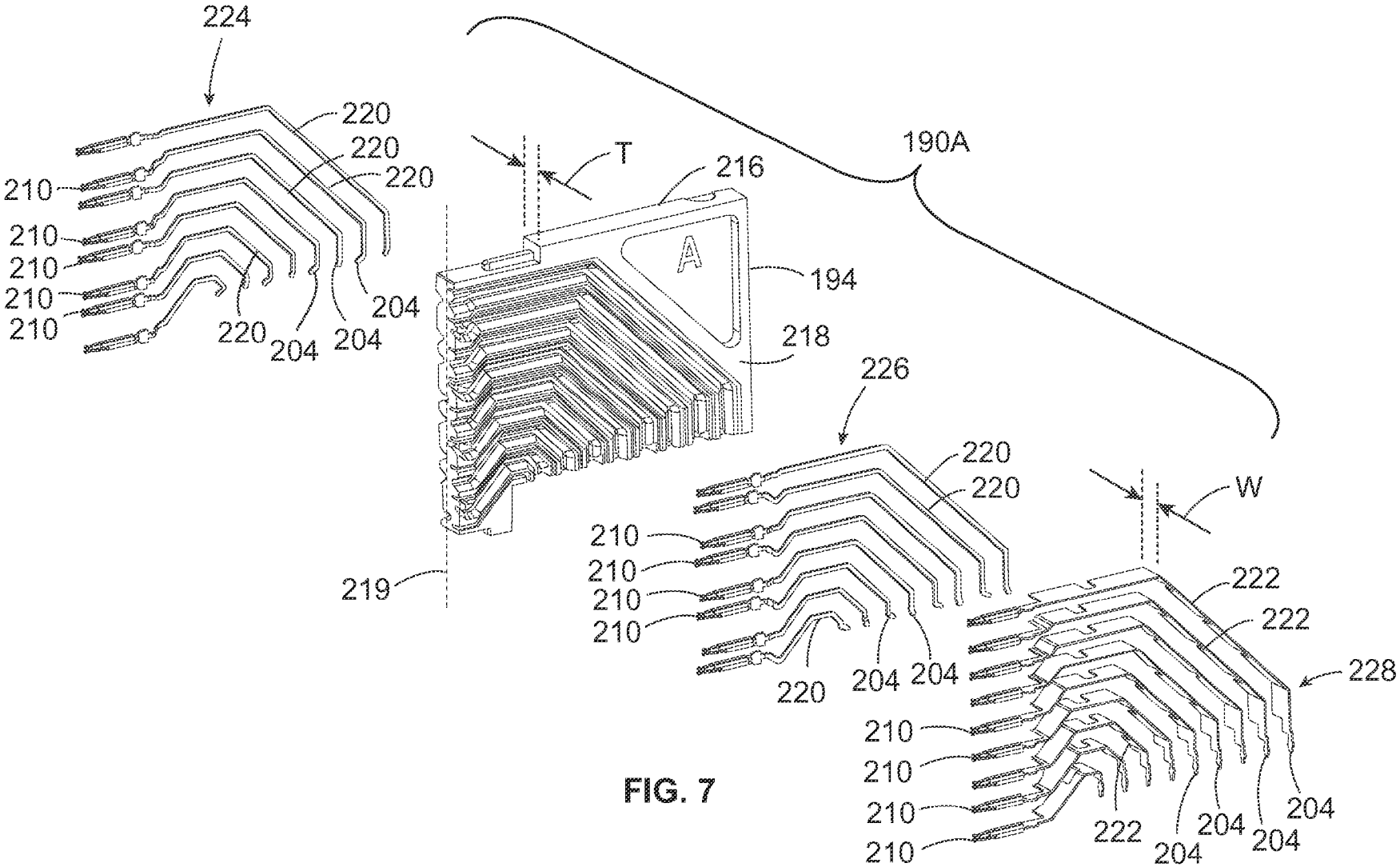
FIG. 7 is an exploded view of the contact module shown in FIG. 5.

FIG. 7 illustrates an exploded view of the contact module 190A. The contact module housing 194 has a thickness T between a first side 216 and a second side 218 opposite the first side 216. The contact module 190A includes a plurality of signal leads 220 and ground leads 222 that provide conductive paths between respective mating contacts 210 and mounting contacts 204. The signal leads are arranged in a first group 224 and a second group 226. The ground leads 222 make up a third group 228. Each ground lead 222 has a width W that is only slightly less than the thickness T of the contact module housing 194. In an exemplary embodiment, the signal leads 220 and ground leads 222 are stitched into the contact module housing 194. In alternative embodiments, the signal lead groups 224 and 226 and the ground lead group 228 may be formed in lead frames (not shown) and over-molded in the contact module housing 194 to form the contact module 190A. The first signal lead group 224 is stitched into the first side 216 of the contact module housing 194 while the second signal lead group 226 and the ground lead group 228 are stitched into the second side 218 of the contact module housing 194. In the assembled contact module 190A the signal lead groups 224 and 226 are positioned on opposite sides if a centerline 219 through the contact module housing 194. Each individual signal lead 220 in the first lead group 224 is positioned adjacent to or beside a signal lead 220 in the second lead group 226 to form a differential signal pair. Ground leads 222 are positioned between each pair of signal leads 220. All of the contact modules 190 including both types 190A and 190B are formed with the same pattern of signal leads 220 and ground leads 222 between the mating and mounting interfaces 172 and 174 respectively. However, at the mating and mounting interfaces 172 and 174 respectively, of the receptacle connector 124, the contact modules 190A exhibit a first one of two different contact patterns at the mating and mounting interfaces 172 and 174 respectively, and the contact modules 190B exhibit a second of the two different contact patterns at the mating and mounting interfaces 172 and 174 respectively, as will be described.

Figure 8:
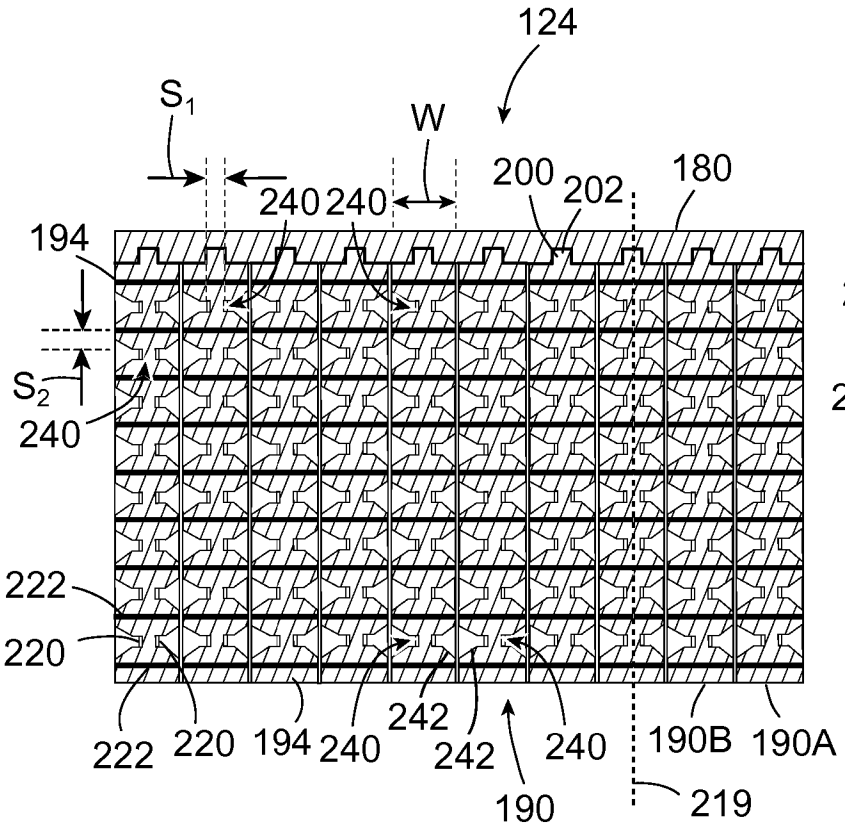
FIG. 8 is a cross-sectional view of a receptacle connector taken along the line 8-8 in FIG. 4.

FIG. 8 illustrates a cross-sectional view of the receptacle connector 124 taken along the line 8-8 in FIG. 4. The cross section shown in FIG. 8 is taken through the shroud 180 and behind the mating interface 172. The alignment keys 200 on the contact module housings 194 are shown received in the slots 202 positioning the contact modules 190 in the receptacle housing 170 (FIG. 4). In each contact module 190, including the contact modules 190A and 190B, the signal and ground leads 220 and 222, respectively, are arranged in a pattern between the mating interface 172 and mounting interface 174 wherein the signal leads 220 are arranged in differential pairs 240 that are positioned side-by-side with respect to the thickness T (FIG. 7) of the contact module housing 194 and positioned between individual ground leads 222. In one embodiment, the signal leads 220 in each signal lead pair 240 are on opposite sides of the centerline 219 of the contact module housing 194.

In each contact module 190, the width W of the ground leads 222 is sufficient to shield the differential signal pairs 240 from adjacent signal pairs 240 to thereby minimize crosstalk between signal pairs 240 within the contact module 190. The contact modules 190 are formed with air spaces or air pockets 242 that separate the signal pairs 240 from the signal pairs 240 in adjacent contact modules 190. The air pockets 242 provide shielding from alien crosstalk from adjacent contact modules 190. When transmitting differential signals, it is desirable that the lengths of the signal paths for the differential signal pair be as closely matched as possible so as to minimize skew in the transmitted signal. With the side-by-side arrangement of the signal leads 220 in the differential signal pair 240, the overall lengths of the signal leads 220 in each differential pair are identical thus eliminating skew within the differential signal pair 240.

The signal leads 220 in the differential signal pairs 240 have a spacing $S_1$ therebetween. A spacing $S_2$ is established between the differential signal pairs 240 and the ground leads 222. The spacings $S_1$ and $S_2$ are selected relative to characteristics of the contact module material and lead material and dimensions to provide a desired impedance through the receptacle connector 124 to facilitate minimizing signal loss. In some embodiments, a lossy material may also be selectively located in the contact module housing 194 to control connector impedance. Known simulation software may be used to optimize such variables for particular design goals including connector impedance. One such simulation software is known as HFSS™ which is available from Ansoft Corporation. In an exemplary embodiment, the receptacle connector 124 has a characteristic impedance of one hundred ohms.

Figure 9:
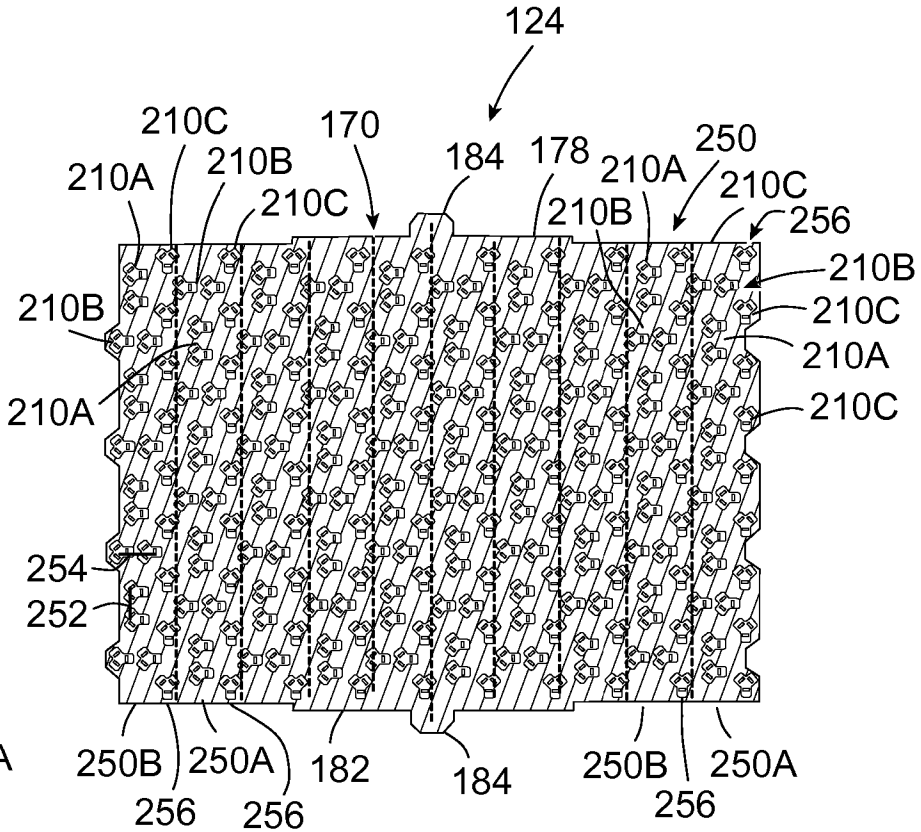
FIG. 9 is a cross-sectional view of a receptacle connector taken along the line 9-9 in FIG. 4.

FIG. 9 illustrates a cross-sectional view of the receptacle connector 124 taken along the line 9-9 in FIG. 4. This cross section is through the receptacle housing 170 at the mating face 172 and is through the tri-beam mating contacts 210 (FIG. 6) which are at ends of the signal and ground leads 220 and 222, respectively. The phantom lines in FIG. 9 extending from the top wall 178 and the bottom wall 182 divide the housing 170 into columns 250 that correspond to the contact modules 190 (FIG. 4) loaded into the receptacle housing 170. At the mating interface 172, the mating contacts 210 are arranged in one of first and second contact patterns, both of which are different from the pattern of signal and ground leads 220 and 222, respectively, between the mating interface 172 and mounting interface 174 described above.

The first and second contact patterns both include vertically coupled signal contact pairs 210A, horizontally coupled signal contact pairs 210B, and individual ground contacts 210C. The vertically coupled contact pairs 210A have a contact axis 252 and the horizontally coupled contact pairs 210B have a contact axis 254 that is substantially perpendicular to the contact axis 252 of the vertically coupled contact pairs 210A. That is, vertically coupled contact pairs 210A and the horizontally coupled contact pairs 210B are angularly offset substantially ninety degrees from one another. It should be recognized that the signal contact pairs 210A and 210B along with the ground contact 210C are structurally identical comprising the tri-beam contacts 210 (FIG. 6) previously described. In one column 250A, the contact pairs 210A, 210B are arranged in a horizontal pair 210B-to-vertical pair 210A-to-horizontal pair 210B alternating sequence from the top wall 178 to the bottom wall 182. The ground contacts 210C are arranged in a column 256 adjacent the signal contact pairs 210A and 210B. In an adjacent column 250B, the contact pairs 210A, 210B are arranged in a vertical pair 210A-to-horizontal pair 210B-to-vertical pair 210A alternating sequence from the top wall 178 to the bottom wall 182. Again, the ground contacts 210C are arranged in a column 256 adjacent the signal contact pairs 210A and 210B. The contact patterns are alternated from one column 250 to the next column 250 across the receptacle housing 170. In each contact module 190 (FIG. 4) the pattern of the mounting contacts 204 (FIG. 5) is the same as that of the mating contacts 210. Thus the mounting interface 174 exhibits the same contact patterns as the mating interface 172. The contact patterns at the mounting and mating interfaces 174 and 172 respectfully, minimize noise at the mounting and mating interfaces 174 and 172.

Figure 10:
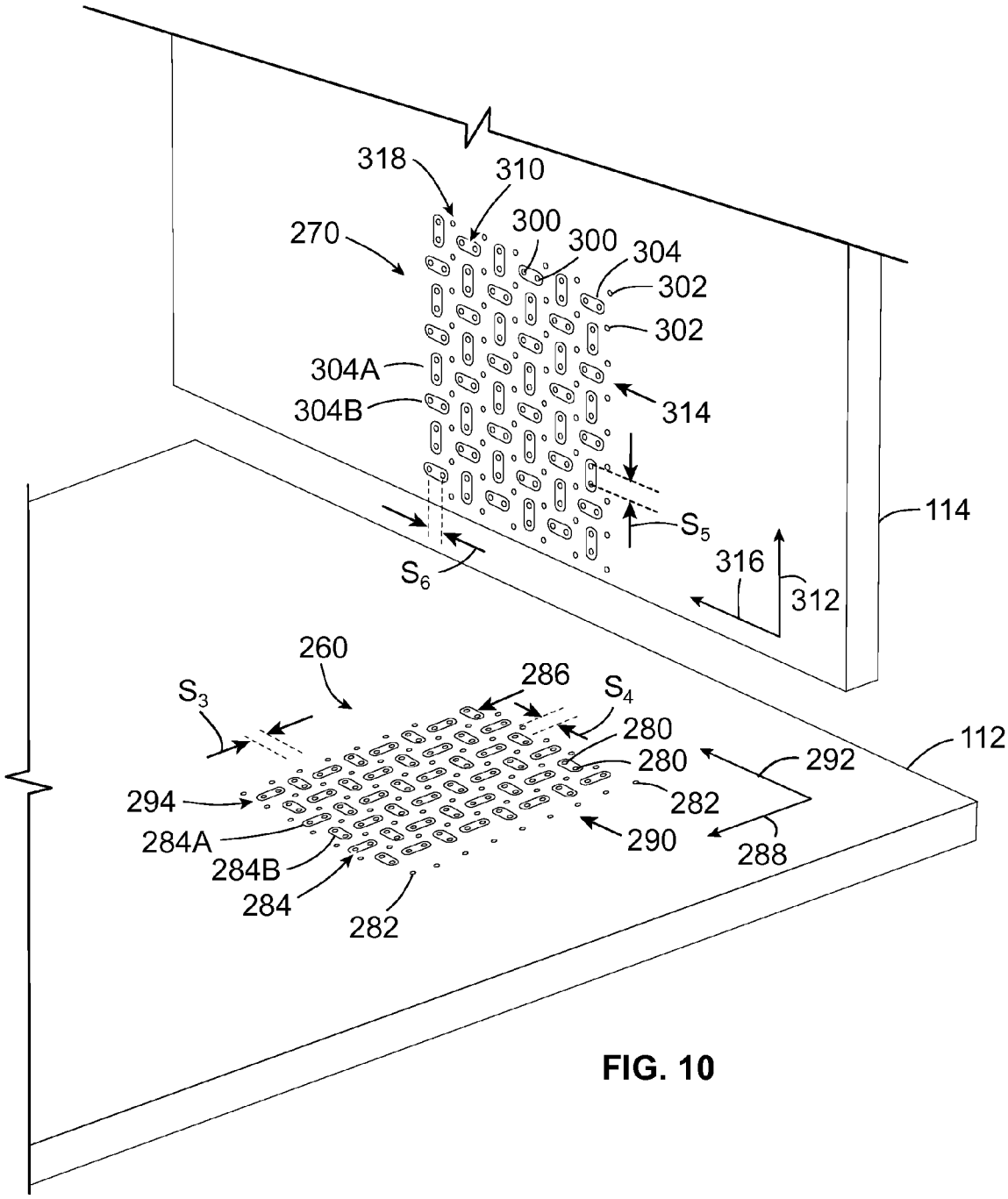
FIG. 10 is a perspective view showing the contact footprints of the backplane board and the daughter board.

FIG. 10 illustrates a perspective view showing the contact aperture patterns or footprints 260 on the backplane board 112 and 270 on the daughter board 114. On the backplane board 112, the apertures include signal contact apertures 280 and ground contact apertures 282. Differential pairs 284 of signal contact apertures 280 are shown encircled together. The differential pairs 284 of signal contact apertures 280 are arranged in columns 286 that extend in the direction of the arrow 288 and rows 290 that extend in the direction of the arrow 292 that is substantially perpendicular to the arrow 288. The contact aperture pattern 260 includes columns 294 of ground contact apertures 282 and columns 286 of differential pairs 284 of signal contact apertures 280 in an alternating sequence. Alternatively, the same pattern exists with respect to the rows 290. Within each column 286 of differential pairs 284, the differential pairs 284 are in one of two patterns, the first being vertically coupled differential pairs 284A-to-horizontally coupled differential pairs 284B-to-vertically coupled differential pairs 284A, and so on. The second pattern has horizontally coupled differential pairs 284B-to-vertically coupled differential pairs 284A-to-horizontally coupled differential pairs 284B, and so on. The patterns of differential pairs 284 are similar but offset with respect to one another. From one differential pair column 286 to the next, the arrangement of the differential pairs 284 of signal contact apertures 280 within the differential pair columns 286 alternates between the first and second differential pair patterns. The vertically coupled differential pairs 284A have a spacing $S_3$ between the contact apertures 280. The horizontally coupled differential pairs 284B have a spacing $S_4$ between the contact apertures 280.

The pattern or footprint 270 of signal contact apertures 300 and ground contact apertures 302 on the daughter board 114 is substantially identical to that of the backplane board 112. Differential pairs 304 of signal contact apertures 300 are shown encircled together. The differential pairs 304 of signal contact apertures 300 are arranged in columns 310 that extend in the direction of the arrow 312 and rows 314 that extend in the direction of the arrow 316 that is substantially perpendicular to the arrow 312. The contact aperture pattern 270 includes columns 318 of ground contact apertures 302 and columns of differential pairs 304 of signal contact apertures 300 in an alternating sequence. As described above with respect to the backplane board 112, within each column 310 of differential pairs 304, the differential pairs 304 are in one of two patterns, the first being vertically coupled differential pairs 304A-to-horizontally coupled differential pairs 304B-to-vertically coupled differential pairs 304A, and so on. The second is horizontally coupled differential pairs 304B-to-vertically coupled differential pairs 304A-to-horizontally coupled differential pairs 304B, and so on. The patterns of differential pairs 304 are similar but offset with respect to one another. From one differential pair column 310 to the next, the arrangement of the differential pairs 304 within the differential pair columns 310 alternates between the first and second differential pair patterns. The vertically coupled differential pairs 304A have a spacing $S_5$ between the contact apertures 300. The horizontally coupled differential pairs 304B have a spacing $S_6$ between the contact apertures 300.

The above described contact aperture footprints on the backplane and daughter board are noise canceling footprints as described in U.S. Pat. No. 7,207,807 which is hereby incorporated by reference in its entirety.

Figure 11:
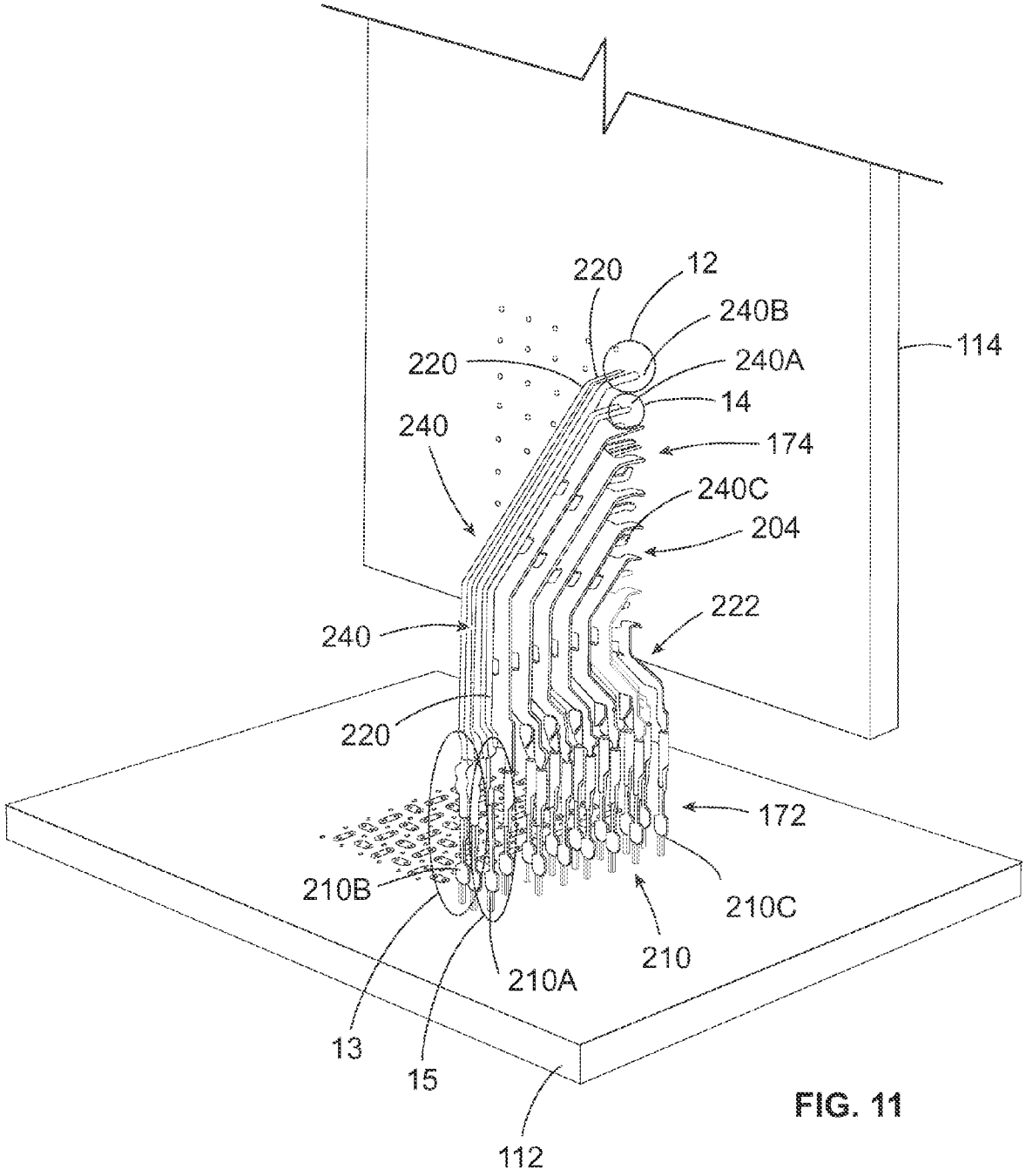
FIG. 11 is a schematic view of signal and ground leads removed from a contact module and interconnecting a backplane board and a daughter board.

FIG. 11 illustrates a schematic view of signal leads 220 and ground leads 222 removed from a contact module and interconnecting the backplane board 112 and the daughter board 114. For clarity, some of the ground leads 222 are not shown. The signal leads 220 are arranged in differential pairs 240. As previously described with reference to FIG. 9, the contacts 210 at the mating interface 172 are arranged in alternating differential pairs of vertically coupled and horizontally coupled signal contacts 210A and 210B, respectively and individual ground contacts 210C. Similarly, the contacts 204 at the mounting interface 174 are arranged in alternating differential pairs of vertically coupled and horizontally coupled signal contacts 204A and 204B, respectively and individual ground contacts 204C. At the mating and mounting interfaces 172 and 174, respectively, each signal lead 220 goes through a transition to arrange the mating and mounting signal contacts 210 and 204 respectively in patterns complementary to the aperture footprints 260 and 270 on the backplane board 112 and the daughter board 114.

Figure 12:
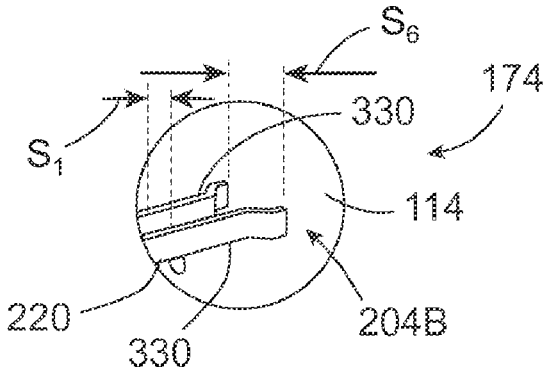
FIG. 12 is an enlarged view of a horizontally coupled signal contact pair at the mounting interface with the daughter board.
Figure 13:
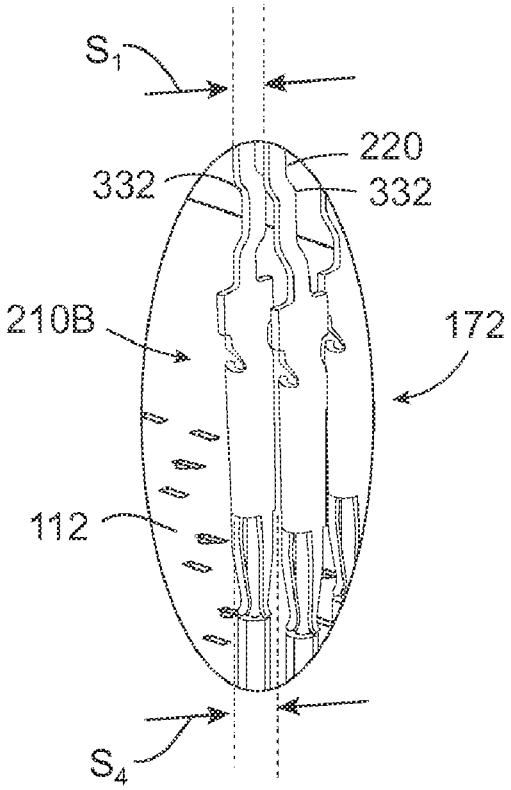
FIG. 13 is an enlarged view of a horizontally coupled signal contact pair at the mating interface with the backplane board.

FIG. 12 illustrates an enlarged view of the horizontally coupled signal contact pair 204B at the mounting interface 174 with the daughter board 114. FIG. 13 illustrates an enlarged view of the horizontally coupled signal contact pair 210B at the mating interface 172 with the backplane board 112. Each signal lead 220 includes transition regions 332 and 330 proximate the mating and mounting interfaces 172 and 174 respectively to position and align the mating contacts 210 and mounting contacts 204 to the corresponding footprints 260 and 270 on the backplane board 112 and the daughter board 114 respectively. Since the signal lead pairs 240 are in a side-by-side arrangement in the contact modules 190, it is only necessary to adjust the contact spacing from the spacing $S_1$ in the contact modules to the spacings $S_4$ and $S_6$ of the noise canceling aperture footprints 260 and 270 respectively. The spacing adjustment is made in the transition regions 332 at the mating interface 172 and 330 at the mounting interface 174.

Figure 14:
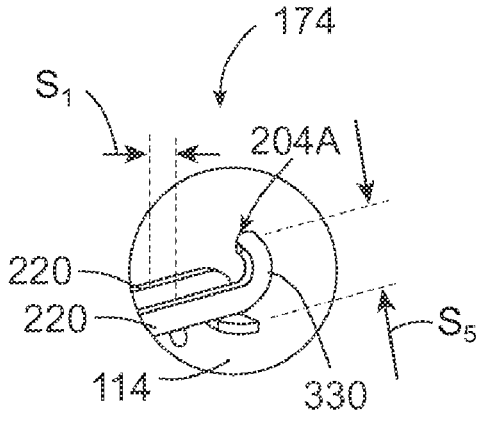
FIG. 14 is an enlarged view of a vertically coupled signal contact pair at the mounting interface with the daughter board.
Figure 15:
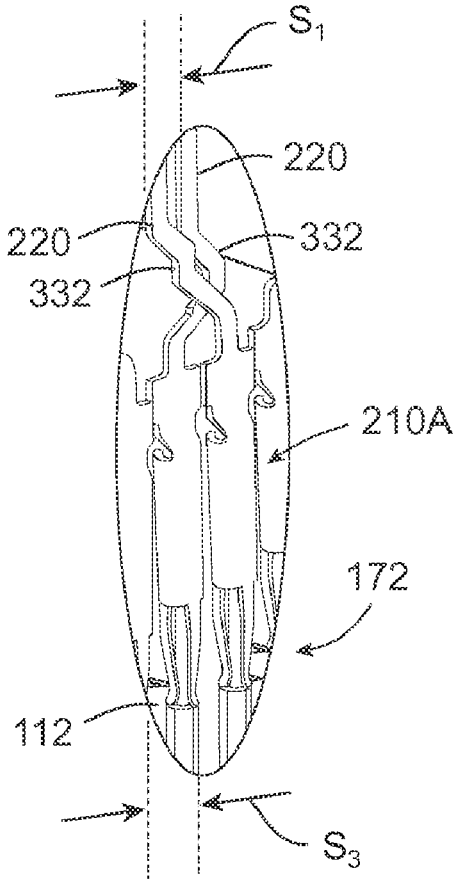
FIG. 15 is an enlarged view of a vertically coupled signal contact pair at the mating interface with the backplane board.

FIG. 14 illustrates an enlarged view of the vertically coupled signal contact pair 204A at the mounting interface 174 with the daughter board 114. FIG. 15 illustrates an enlarged view of the vertically coupled signal contact pair 210A at the mating interface 172 with the backplane board 112. With the vertical coupling in FIGS. 14 and 15, the orientation of the signal leads 220 is changed from the side-by-side orientation between the mating and mounting interfaces 172 and 174 in the contact module 190 to an orientation wherein the contact axis 252 (see FIG. 9) of the differential pair 210A is substantially perpendicular to the side-by-side orientation of the signal leads 220. The transition occurs in the transition regions 330 and 332. The transition also includes adjusting the contact spacing from the spacing $S_1$ between the signal lead pairs in the contact module 190 to the spacings $S_3$ and $S_5$ of the noise canceling aperture footprints 260 and 270 respectively.

The embodiments herein described provide an electrical connector assembly 110 for interconnecting circuit boards 112, 114. The connector assembly 110 includes a header connector 120 and a receptacle connector 124 that carry differential signals and exhibit low noise characteristics. The receptacle connector 124 includes contact modules 190 having signal lead pairs 240 positioned side-by-side between individual ground leads 222. The arrangement of the signal lead pairs 240 and ground leads 222 is transitioned to conform to noise canceling footprints at the circuit boards 112, 114. Within differential pairs, skew in minimized. A predetermined impedance is maintained through the connector to facilitate minimizing signal loss.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. An electrical connector comprising:

a housing defining a connector mating interface, said housing holding a plurality of contact modules that cooperate to define a connector mounting interface, each said contact module containing signal leads and ground leads arranged in an alternating pattern of individual said ground leads and pairs of said signal leads positioned side-by-side with respect to a thickness of said contact module and;

said signal and ground leads having respective mating contacts proximate said mating interface and respective mounting contacts proximate said mounting interface, said mating and mounting contacts within each said contact module being arranged in one of first and second contact patterns different from the pattern of said signal and ground leads, and wherein said mating and mounting contacts in adjacent said contact modules are arranged in respective different ones of said first and second contact patterns.

2. The connector of claim 1, wherein each of said first and second contact patterns includes a column of ground contacts adjacent a column including signal contacts in alternating vertically coupled pairs and horizontally coupled pairs and wherein said arrangement of signal contact pairs in said second contact pattern is offset from said arrangement of said signal contact pairs of said first contact pattern.

3. The connector of claim 2, wherein said pairs of signal leads are without skew.

4. The connector of claim 2, wherein said pairs of signal leads are configured to carry differential signals.

5. The connector of claim 1, wherein said mating interface and said mounting interface are substantially perpendicular to one another.

6. The connector of claim 1, wherein each of said ground leads has a width sufficient to shield a pair of signal leads from other signal leads within the same contact module.

7. The connector of claim 1, wherein air pockets between adjacent contact modules shield said signal leads from signal leads in adjacent contact modules.

8. The connector of claim 1, wherein each said contact module includes a housing having a centerline and wherein said signal leads in each contact module are arranged in a first group positioned on one side of said centerline and a second group positioned on the other side of said centerline and wherein each said pair of signal leads includes a signal lead from each of said first and second groups.

9. The connector of claim 1, wherein each signal lead includes transition regions proximate said mating interface and mounting interface to position and orient said mating and mounting contacts in a respective one of said first and second contact patterns.

10. The connector of claim 1, wherein said contact modules include a first spacing between said pairs of signal leads and a second spacing between said signal leads and ground leads, and wherein said first and second spacings are selected to provide a predetermined impedance through the connector.

11. An electrical connector assembly comprising:

a header connector including a housing holding a plurality of header contacts in a noise canceling arrangement;

a receptacle connector matable with said header connector, said receptacle connector comprising:

a receptacle housing defining a connector mating interface, said receptacle housing holding a plurality of contact modules that cooperate to define a connector mounting interface, each said contact module containing signal leads and ground leads arranged in an alternating pattern of individual said ground leads and pairs of said signal leads positioned side-by-side with respect to a thickness of said contact module and;

said signal and ground leads having respective mating contacts proximate said mating interface and respective mounting contacts proximate said mounting interface, said mating and mounting contacts within each said contact module being arranged in one of first and second contact patterns different from the pattern of said signal and ground leads, and wherein said mating and mounting contacts in adjacent said contact modules are arranged in respective different ones of said first and second contact patterns.

12. The connector assembly of claim 11, wherein each of said first and second contact patterns includes a column of ground contacts adjacent a column including signal contacts in alternating vertically coupled pairs and horizontally coupled pairs and wherein said arrangement of signal contact pairs in said second contact pattern is offset from said arrangement of said signal contact pairs of said first contact pattern.

13. The connector assembly of claim 12, wherein said pairs of signal leads are without skew.

14. The connector assembly of claim 12, wherein said pairs of signal leads are configured to carry differential signals.

15. The connector assembly of claim 11, wherein said mating interface and said mounting interface are substantially perpendicular to one another.

16. The connector assembly of claim 11, wherein each of said ground leads has a width sufficient to shield a pair of signal leads from other signal leads within the same contact module.

17. The connector assembly of claim 11, wherein air pockets between adjacent contact modules shield said signal leads from signal leads in adjacent contact modules.

18. The connector assembly of claim 11, wherein each said contact module includes a housing having a centerline and wherein said signal leads in each contact module are arranged in a first group positioned on one side of said centerline and a second group positioned on the other side of said centerline and wherein each said pair of signal leads includes a signal lead from each of said first and second groups.

19. The connector assembly of claim 11, wherein each signal lead includes transition regions proximate said mating interface and mounting interface to position and orient said mating and mounting contacts in a respective one of said first and second contact patterns.

20. The connector assembly of claim 11, wherein said contact modules include a first spacing between said pairs of signal leads and a second spacing between said signal leads and ground leads, and wherein said first and second spacings are selected to provide a predetermined impedance through the connector.

* * * * *